US007376554B2

(12) United States Patent
Ojala et al.

(10) Patent No.: US 7,376,554 B2
(45) Date of Patent: May 20, 2008

(54) EXCITATION FOR HIGHER BAND CODING IN A CODEC UTILISING BAND SPLIT CODING METHODS

(75) Inventors: Pasi S. Ojala, Lempäälä (FI); Janne Vainio, Lempäälä (FI); Hannu J. Mikkola, Tampere (FI)

(73) Assignee: Nokia Corporation, Espoo (FI)

( * ) Notice: Subject to any disclaimer, the term of this patent is extended or adjusted under 35 U.S.C. 154(b) by 669 days.

(21) Appl. No.: 10/891,846

(22) Filed: Jul. 14, 2004

(65) Prior Publication Data

US 2005/0065783 A1 Mar. 24, 2005

(30) Foreign Application Priority Data

Jul. 14, 2003 (FI) ..... 20031069

(51) Int. Cl.
*G10L 11/04* (2006.01)

(52) U.S. Cl. ..... 704/207; 704/205; 704/206; 375/240

(58) Field of Classification Search ..... 704/203, 704/201, 205, 206, 207; 375/240
See application file for complete search history.

(56) References Cited

U.S. PATENT DOCUMENTS

| | | | | |
|---|---|---|---|---|
| 6,182,031 | B1 | 1/2001 | Kidder et al. | |
| 6,680,972 | B1 * | 1/2004 | Liljeryd et al. | 375/240 |
| 2002/0007280 | A1 | 1/2002 | McCree | |
| 2003/0093264 | A1 | 5/2003 | Miyasaka et al. | |

OTHER PUBLICATIONS

Chaemmaghami S; Deriche M: A new approach to modeling excitation in very low-rate speech coding. Proceedings of the 1998 IEEE International Conference on Acoustics, Speech and Signal Processing (May 12-15, 1998/New York, NY).

Changchun Bao: Harmonic excitation LPC (HE-LPC) speech coding at 2.3 kb/s. 2003 IEEE International Conference on Acoustics, Speech, and Signal Processing (Apr. 6-10, 2003/Hong Kong, China).

Yasheng Qian and Peter Kabal (Dept. of Electrical and Computer Engineering, McGill University): Pseudo-Wideband Speech Reconstruction from Telephone Speech. Proc. Biennial Symposium on Communications (Jun. 2002/Kingston, ON); pp. 524-527.

J.R. Epps, et al.; "*A New Very Low Bit Rate Wideband Speech Coder With A Sinusoidal Highband Model*"; ISCAS 2001; proceedings of the 2001 IEEE International Symposium on Circuits and Systems; vol. 1 of 5; May 6, 2001; pp. 349-352.

* cited by examiner

*Primary Examiner*—Huyen X. Vo
(74) *Attorney, Agent, or Firm*—Alfred A. Fressola; Ware, Fressola, Van Der Sluys & Adolphson LLP

(57) ABSTRACT

Methods and arrangements are disclosed for digitally encoding and decoding sound—An input signal is split (811) into a primary frequency band and at least one secondary frequency band. The parts of the input signal in the frequency bands are separately encoded. Certain characteristics of the input signal in the primary frequency band and corresponding characteristics of the input signal in at least one secondary frequency band are examined (302, 303, 814) in order to find out, whether there is certain resemblance therebetween. Alternatively certain characteristic features of the process applied to encoding the primary frequency band extracted (305, 813) and used (307) in encoding the secondary frequency band, or such extracted characteristic features are replaced (306, 501, 701, 815) with a locally generated, independent set of corresponding features.

29 Claims, 7 Drawing Sheets

EXCITATION FOR HIGHER BAND CODING IN A CODEC UTILISING BAND SPLIT CODING METHODS

CROSS-REFERENCE TO RELATED APPLICATIONS

This application claims priority under 35 USC §119 to Finnish Patent Application No. 20031069 filed on Jul. 14, 2003.

TECHNICAL FIELD

The invention concerns generally the technology of digital encoding and decoding of sound. Especially the invention concerns the problem of enabling natural reconstruction of sounds after transmission through a channel in which band split coding methods are utilised for encoding the sound for transmission in digital form.

BACKGROUND OF THE INVENTION

Linear Predictive Coding (LPC) is a digital sound encoding principle according to which the encoder repeatedly constructs, for each short sequence of input samples, a linear all-pole filter that with a certain excitation signal enables producing a replica of the corresponding input sample sequence. The encoder transmits information representing the filter parameters and the exitation signal to the decoder. Known variations of LPC include but are not limited to transformation coding or code excitation according to what is the selected approach to generating the excitation signal, as well as various selections with respect to whether filter parameters are transmitted directly or in some transformed form. Such variations have no effect to the applicability of the general principle of the present invention.

The selection of input signal bandwidth has great influence to the naturalness of the eventually reproduced sound. A narrow bandwidth of the input signal is advantageous in terms of saving required transmission capacity. Accepting a wider band of input frequencies to encoding would enable reproducing the sound in a more natural way at the receiving end, but simultaneously increases the demand for transmission bandwidth.

FIG. 1 illustrates a band split coding principle that offers possibilities for enhancing the quality of reproduced sound while keeping requirements for transmission bandwidth reasonable. The signal coming from an input signal source 101 is taken through a band split filter 102, which directs a certain lower band of the input signal frequencies to a low band encoder 103 and a corresponding upper band of the input signal frequencies to a high band encoder 104. In the digital encoding of speech the lower band includes frequencies from a lower limit near zero to a few kHz, for example 3.4 kHz or 6.4 kHz. The upper band extends above the lower band to some upper limit, like 8 kHz or 12 kHz. The output signals of the low and high band encoders 103 and 104 are combined for transmission and transmitted through some transmitting channel 105 to a receiving device, where a low band decoder 106 and a high band decoder 107 decode the parts of the transmitted signal coming from the low band encoder 103 and high band encoder 104 respectively. A band reconstruction block 108 combines the outputs of the low and high band decoders 106 and 107, after which the reconstructed signal is taken to a sound reproducing arrangement or corresponding signal sink 109.

In a very basic arrangement the low and high band encoders 103 and 104 operate independently, and selection is applied according to whether the outputs of both of them or only the low band encoder 103 are transmitted. More advanced arrangements utilise some information from the low band encoding and decoding in performing the high band encoding and decoding respectively, which is illustrated as vertical arrows between the appropriate functional blocks in FIG. 1. The principle is generally referred to as bandwith extension, and it works well with input signals like speech, where correlation between the low and high bands is strong. Bandwidth extension is discussed for example in a prior art publication Yasheng Qian, Peter Kabal: "Pseudo-wideband speech reconstruction from telephone speech", Proc. Biennial Symposium on Communications (Kingston, ON), pp. 524-527, June 2002.

FIG. 2 illustrates a known arrangement for high band encoding, in which an input signal coming from a band split filter is subjected to LPC analysis in block 201. From an associated low band encoder an excitation signal is taken. Due to a different excitation sampling frequency the low band excitation signal is not directly usable in the high band encoder, but this can be corrected by taking it through a resampling block 202, which resamples the low band excitation signal onto a suitable sampling frequency. The LPC parameters from the LPC analyser block 201 and the resampled low band extension signal from the resampling block 202 are directed to an LPC synthesis block 203, which produces a synthesized high band signal. The LPC synthesis function implemented in block 203 is an inverse of the LPC analysis function of block 201, so transmitting the parameters used in the LPC synthesis will enable a receiver (not shown in FIG. 2) to similarly synthesize the high band signal. In order to align the synthesized signal energy with the original high band signal the high band signal gain needs to be calculated in a gain control block 204, which is coupled to receive the original high band audio signal (or at least information about its signal energy) as well as the output of the LPC synthesis block 203. The output of the gain control block 204 is transmitted to the receiver along with the parameters obtained from block 203.

The drawback of the arrangement of FIG. 2 is that in situations where the low band contains a strongly voiced signal but the frequency spectrum of the high band is relatively flat, it causes annoying, unnatural effects to the synthesized audio signal. This effect is rarely encountered with speech, but is clearly noticeable for example when the input signal is music.

SUMMARY OF THE INVENTION

An objective of the present invention is to present a method and an apparatus for digitally encoding and decoding sound in a band split arrangement, so that the synthesized sound after decoding would be as natural as possible regardless of the type of the input signal. A further objective of the invention is to implement a principle of said kind without causing extensive need for additional transmission resources. A yet further objective of the invention is to enable implementation of the above-explained principles with reasonable requirements to system complexity.

The objectives of the invention are achieved by having at least one alternative source for the high band excitation signal, and by selecting the appropriate excitation signal source for the high band on the basis of analysed characteristics of the audio signal to be encoded.

The features of encoding and decoding methods according to the invention are characterised by the features recited in the characterising parts of the independent patent claims directed to encoding and decoding methods respectively.

The invention also applies to transmitting and receiving devices. The characterised features of the transmitting and receiving devices are recited in the characterising parts of the independent patent claims directed to transmitting and receiving devices respectively.

The suboptimal performance of the known prior art band split encoding and decoding arrangement stems from the fact that using an excitation signal associated with a strongly voiced first band input signal tries to introduce periodicity onto the second band even when none should be present. According to the invention it is possible to avoid such unintentional distortion of the second band frequency spectrum by using an alternative excitation signal for the upper band, when a comparison of the degree of voicedness shows a mismatch between the bands.

There are a number of ways for examining, whether an input signal on a certain frequency band has voiced or unvoiced characteristics. For example the long-term correlation gain calculated for long-term prediction is a good indicator of periodicity and thus voicedness of an input signal. Other possible indicators include but are not limited to various statistical values derived from the Fourier transform of a signal sequence. An encoder according to the invention analyses separately the first (lower) band input signal and the second (higher) band input signal. It produces values indicative of the voiced/unvoiced character of the signals on the different bands. If these values show that the first (lower) band signal is voiced but the second (higher) band signal is not, excitation taken from the first band is not copied into the encoding of the second band, but an alternative (preferably random) excitation is used instead.

Using an alternative (typically random) excitation signal for the second band introduces potentially a problem of excitation gain mismatch. In prior art solutions the excitation gain is determined to set the copied first band excitation energy to the same level with the second band LPC residual. It is natural that there is some dependence between the second band LPC residual and the first band excitatsion that basically represents the low band LPC residual. If the excitation for the second band is independent from the first band, any such dependence in excitation energy is lost. Therefore the difference in energy between the independent second band excitation signal and the second band LPC residual may become extremely large compared to that between an excitation signal derived from the first band and the LPC residual of the second band. The quantisation of the excitation gain becomes more difficult when the dynamics thereof is increased.

A solution to the excitation gain mismatch problem is to normalise the second (independent) excitation signal energy to that of the first band excitation signal, even if the former and not the latter is used as the actual second band excitation signal due to detected difference in voiced/unvoiced characteristics of the bands. Two advantages are gained therethrough. Firstly, the dynamics of the excitation signal gain on the second band are the same and the above-explained extremely large differences are avoided. Secondly the arrangement enhances robustness against errors in the transmission channel. The selection of the second band excitation signal must be transmitted to the receiver, which involves a risk of a transmission error that causes the receiver to misinterpret the transmitted selection signal. Due to the excitation signal energy normalisation, such an error will not cause severe distortion in the second band, because the energy level of the wrongly selected excitation signal is the same as that of the correct one.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

The exemplary embodiments of the invention presented in this patent application are not to be interpreted to pose limitations to the applicability of the appended claims. The verb "to comprise" is used in this patent application as an open limitation that does not exclude the existence of also unrecited features. The features recited in depending claims are mutually freely combinable unless otherwise explicitly stated.

Figure 1:
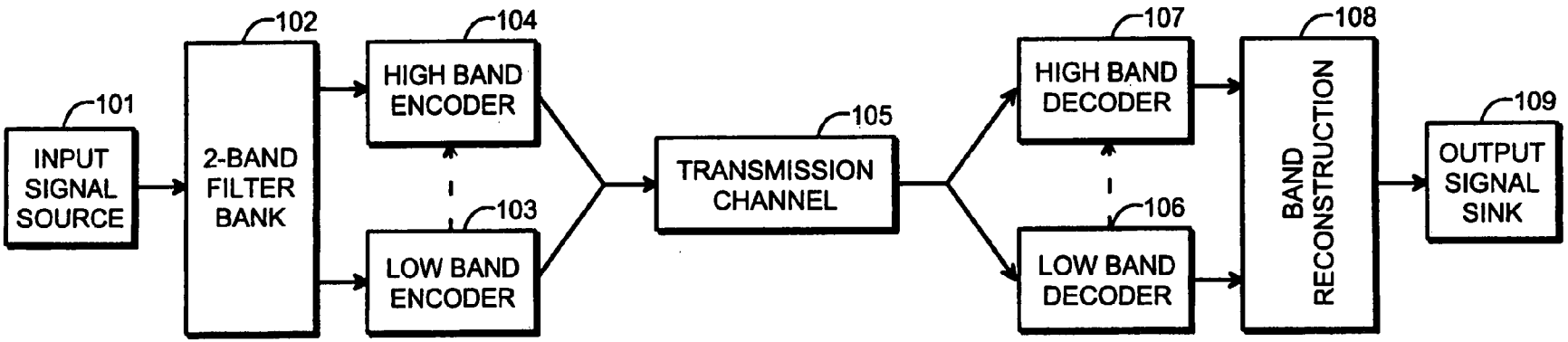
Fig. 1 PRIOR ART
FIG. 1 illustrates the principle of band split encoding and decoding.
Figure 2:
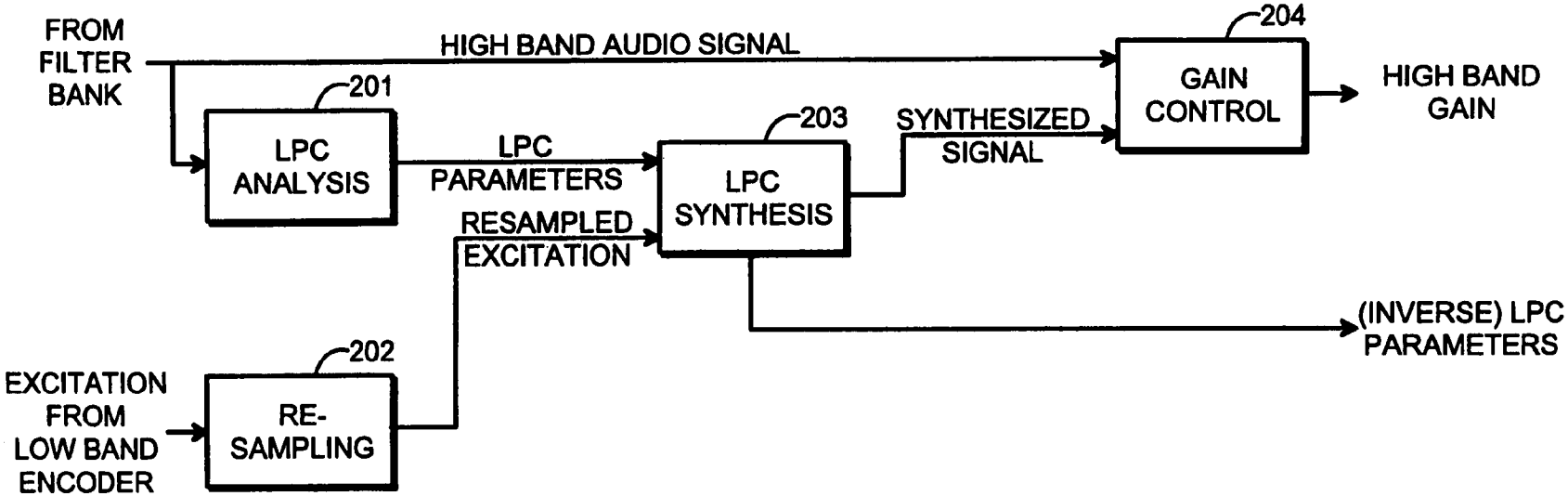
Fig. 2 PRIOR ART
FIG. 2 illustrates a prior art bandwidth extension arrangement.
Figure 3:
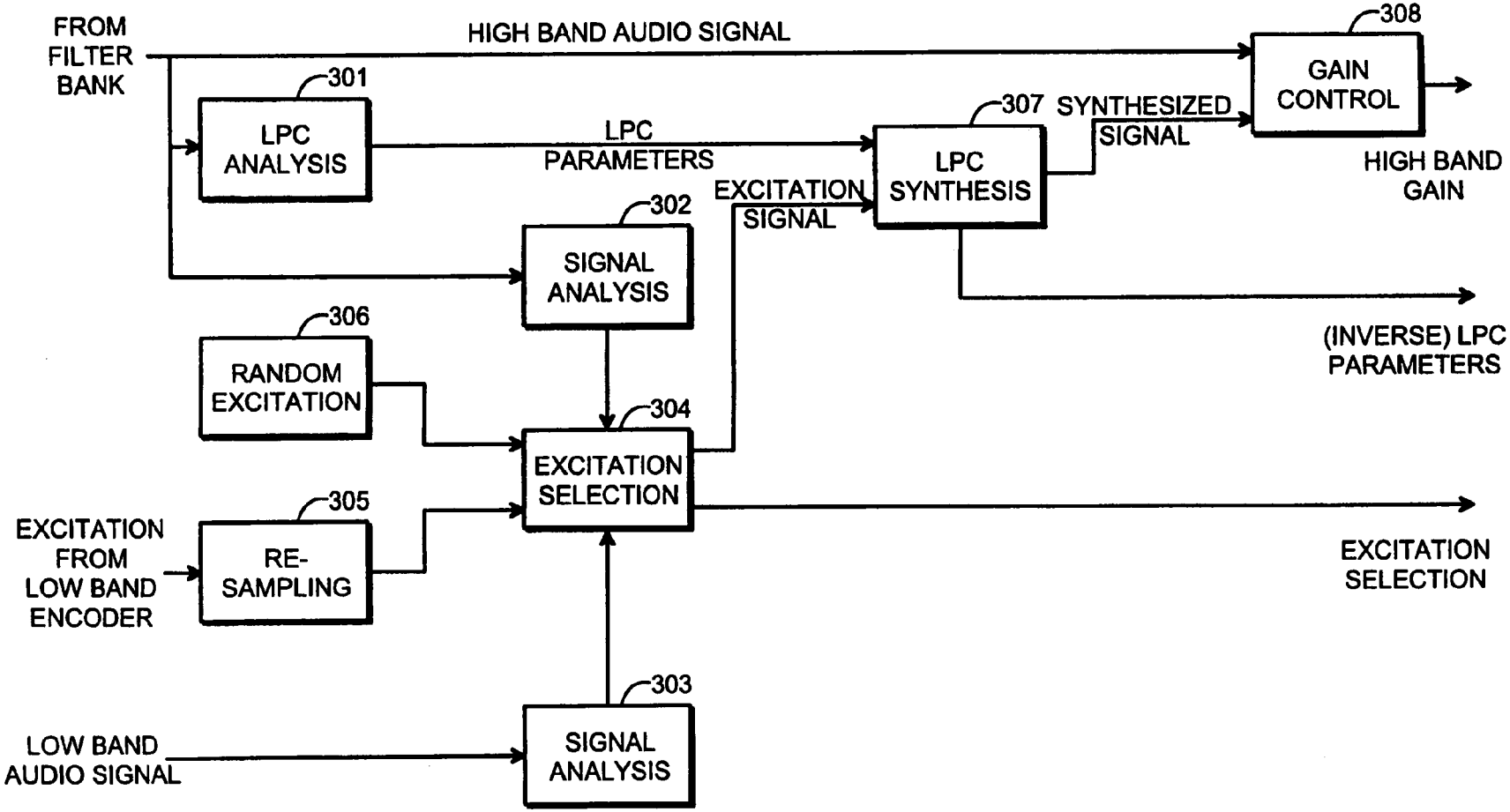
FIG. 3 illustrates an encoding principle according to an embodiment of the invention.

FIG. 3 is a functional block diagram of an encoder according to an embodiment of the invention. An LPC analysis block 301 is arranged to perform an LPC analysis on a high band audio signal coming from a filter bank or corresponding apparatus the task of which is to separate the frequency bands of the original audio signal. The result of the LPC analysis is a set of LPC parameters, which as such is in accordance with prior art arrangements. However, the high band audio signal goes also to a signal analysis functionality 302, which is arranged to make a certain deduction according to rules that are described in more detail later. A low band audio signal from the filter bank or from a low band LPC encoder goes to another signal analysis functionality 303, which is similarly arranged to make a certain deduction. With suitable scheduling of tasks the signal analysis functionalities 302 and 303 may physically be only one entity.

The deductions from the signal analysis functionalities 302 and 303 are taken to an excitation selection switch 304. It is arranged to select one of a resampled low band excitation coming from a resampling block 305 or a random excitation, such as white noise excitation, coming from a random excitation source 306. The excitation selection switch 304 delivers the selected excitation to an LPC synthesis functionality 307, which also receives the LPC parameters from the LPC analysis block 301. A synthesized high band audio signal goes from the LPC synthesis functionality 307 to a gain control block 308, which also receives the original high band audio signal. The gain control block 308 is arranged to determine a gain control signal that is needed to align the synthesized signal energy with that of the original high band audio signal.

Information that will be sent to a receiving device comprises (inverse) LPC parameters from the LPC synthesis functionality 307, a high band synthesis gain control signal from the gain control block 308 as well as an excitation selection signal from the excitation selection switch 304. The last-mentioned signal indicates, which of the available excitation sources was used.

The deductions produced in the signal analysis functionalities 302 and 303 should enable the excitation selection switch 304 to select the resampled low band excitation signal whenever there is enough correlation between the low band and the high band to justify such selection. On the other hand the excitation selection switch 304 should select the random excitation signal in all cases where such correlation does not exist. A general rule for making the deductions and the selection based thereupon is the following: "If the low band signal is voiced and the high band signal is unvoiced, select the random excitation signal. In all other cases select the resampled low band excitation signal."

Figure 4:
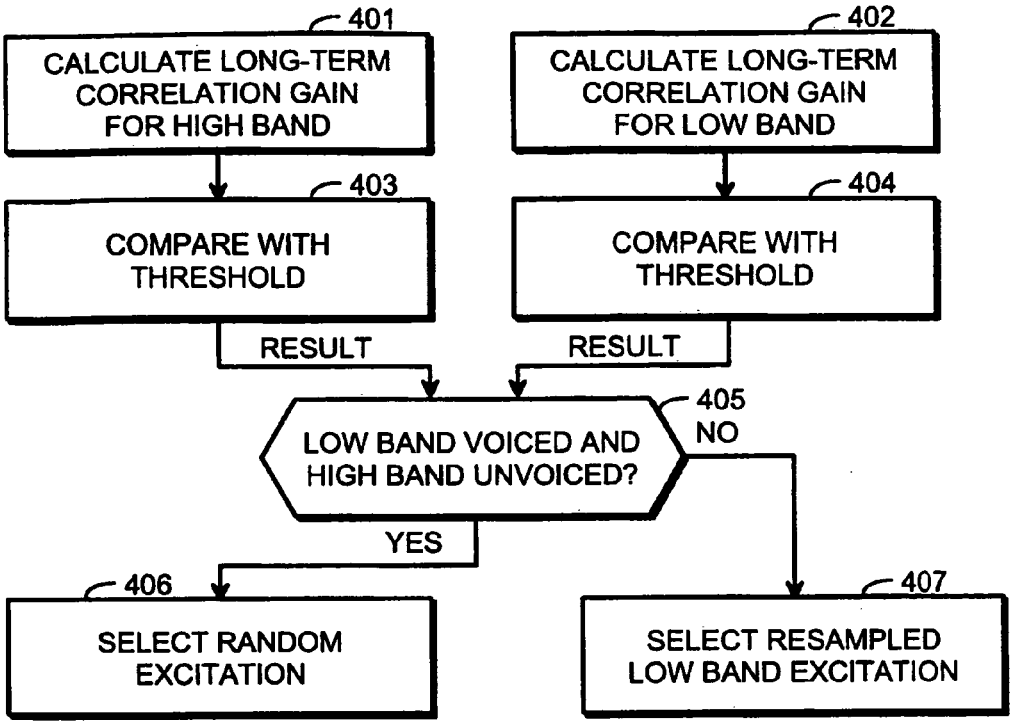
FIG. 4 illustrates the selection of an excitation signal in a method according to an embodiment of the invention.

FIG. 4 illustrates a simple exemplary decision-making flow for selecting the excitation signal. Step 401 corresponds to calculating a long-term correlation gain for the high band signal, and step 402 corresponds to calculating a long-term correlation gain for the low band signal. Calculating long-term correlation gains is known as such from the technology of long-term prediction (LTP). At steps 403 and 404 the calculated long-term correlation gains for the high and low band signals respectively are compared against certain predetermined threshold values. The exact way in which such threshold values have been determined is not important to the present invention; typically certain selected threshold values result from experimenting. The meaning of the threshold values is to classify signals as voiced or unvoiced. If a long-term correlation gain calculated for a certain signal is lower than the corresponding threshold value, the signal is considered to be unvoiced. If the calculated long-term correlation gain is (equal to or) greater than the threshold value, the signal in question is considered to be voiced.

In the functional block diagram of FIG. 3 steps 401 and 403 of FIG. 4 are executed in the high band signal analysis block 302 and steps 402 and 404 of FIG. 4 are executed in the low band signal analysis block 303. The following step 405 is a comparison between the above-or-below-threshold results coming from steps 403 and 404. If the low band is considered to be voiced and the high band unvoiced, the random excitation is selected at step 406. In other cases the resampled low band excitation is selected at step 407. Steps 405, 406 and 407 of FIG. 4 correspond to activity in the functional block 304 of FIG. 3.

The basic arrangement described above with reference to FIGS. 3 and 4 manages to avoid the prior art problems related to unintentionally introducing periodicity into the high band when none should be present, because in such cases the random excitation source will be selected.

Figure 5:
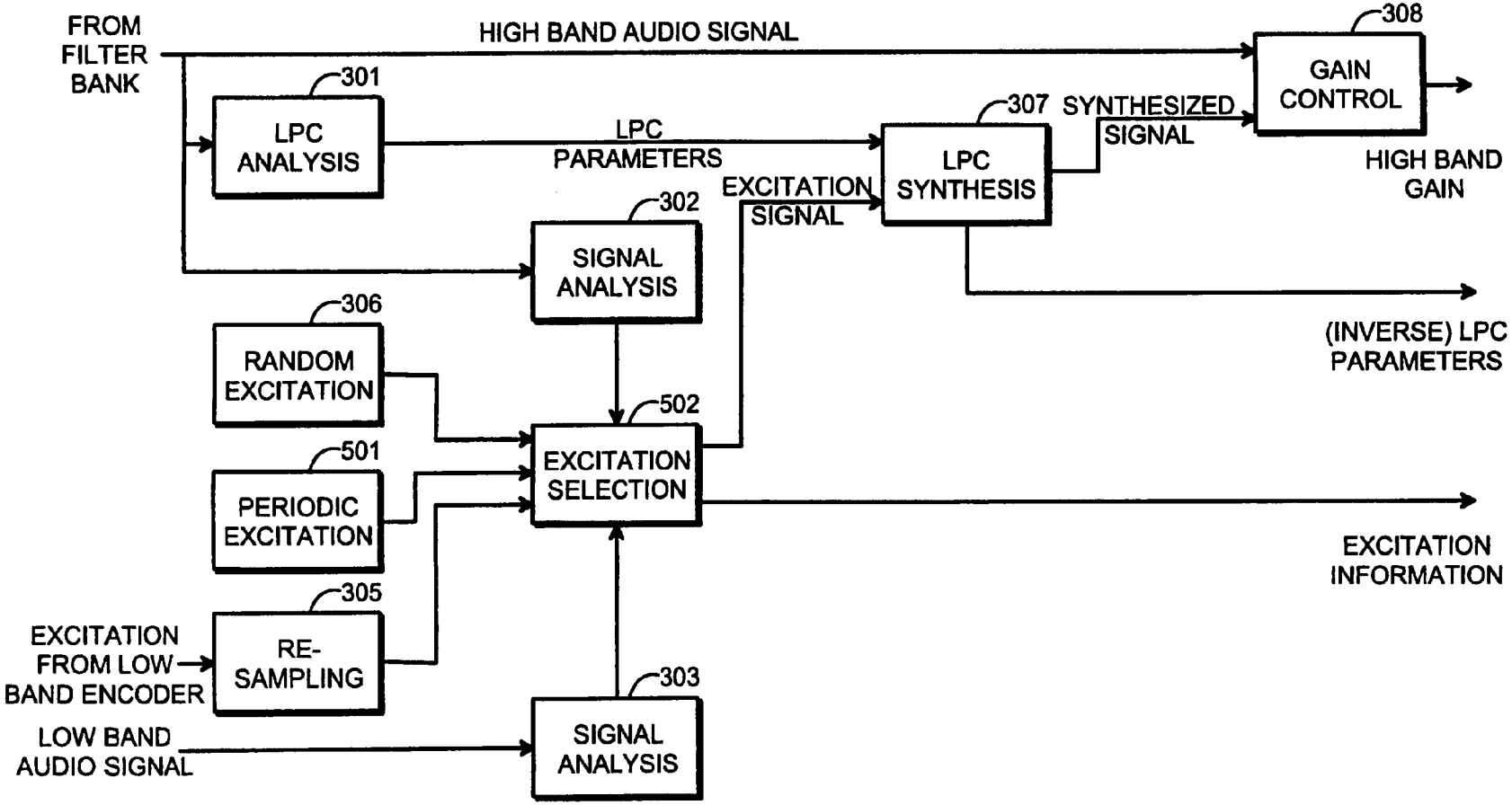
FIG. 5 illustrates an encoding principle according to another embodiment of the invention.

We may consider a situation in which the high band is voiced but the low band is not. Such a situation is exceptional and will be rarely encountered in practice. However, it must be noted that in such cases the arrangement described above with reference to FIGS. 3 and 4 selects a nonperiodic excitation for the high band, even if a periodic excitation might actually be better. In order to prepare for even such exceptional cases the improved embodiment of FIGS. 5 and 6 may be presented. The functional block diagram of FIG. 5 is otherwise equal to that of FIG. 3, but a third possible high band excitation signal source is added parallel to the low band excitation resampling block 305 and the random excitation source 306. The third possibility is a periodic excitation signal source 501. The excitation selection switch 502 is now arranged to select one of three possible excitation signal sources and to transmit excitation information towards a receiving device. The excitation information meant in FIG. 5 differs from the excitation selection signal of FIG. 3 in that in addition to the simple alternatives "selected resampled low band excitation" or "selected random excitation" it must, when necessary, be able to convey some information about the selected periodic excitation coming from block 501. The exact way in which such information is conveyed is not important to the present invention. Prior art solutions describing one-band LPC encoding and decoding solutions is widely known to suggest and discuss transmitting such information in general.

Figure 6:
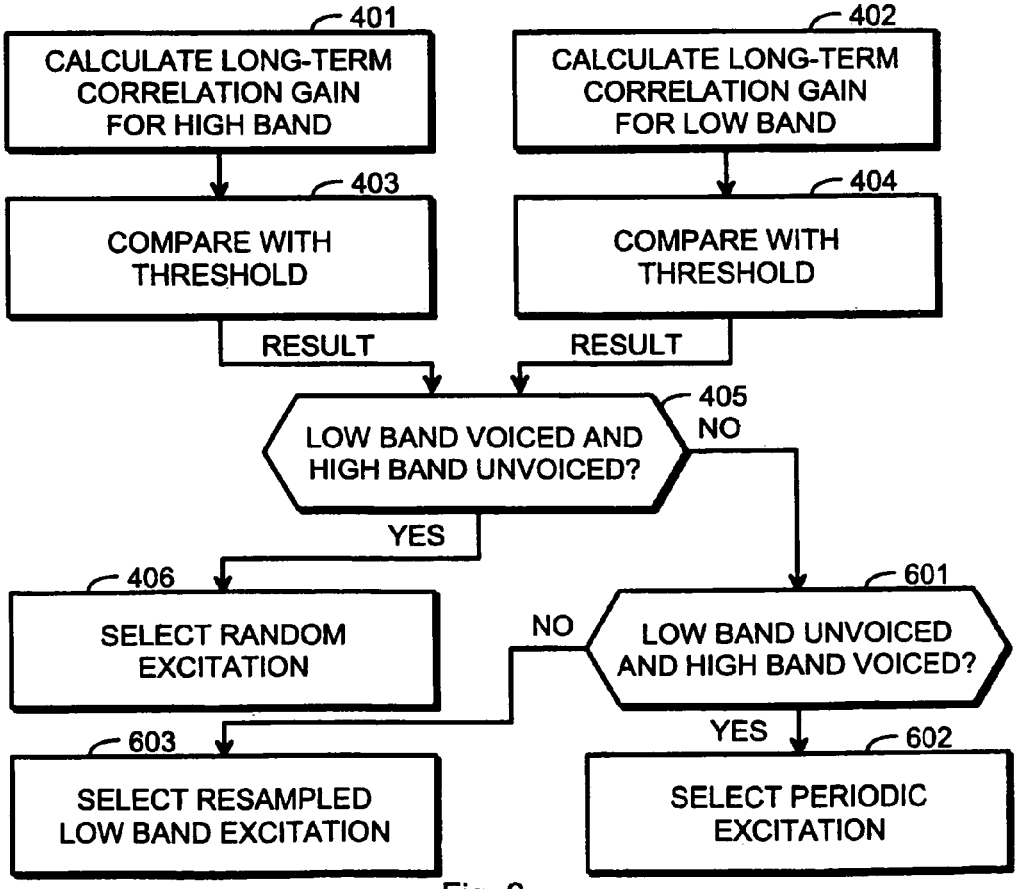
FIG. 6 illustrates the selection of an excitation signal in a method according to another embodiment of the invention.

FIG. 6 illustrates an exemplary decision flow in analogy with FIG. 4. This time a negative finding at step 405 leads to step 601, after which if the low band is considered to be unvoiced and the high band voiced, the periodic excitation is selected at step 602. In other cases the resampled low band excitation is selected at step 603. In other words, situations that lead to selecting the resampled low band excitation are those where the high and low band signals are similar in the sense that either both are voiced or both are unvoiced. Steps 405, 406, 601,602 and 603 of FIG. 6 correspond to activity in the functional block 502 of FIG. 5.

When we compare the use of the resampled low band excitation signal to the use of some other excitation signal generated "locally" for the needs of the high band encoder, we note that the former comes with a variable signal power that basically represents the low band LPC residual. Locally generated excitation signals have no similar correlation with any part of the original audio signal, but come at more or less constant signal power level. This creates a problem, because a momentary difference in energy between a locally generated excitation signal and the high band LPC residual may become extremely large. When the required dynamic range of gain control increases, the quantization of the excitation gain becomes more difficult.

Figure 7:
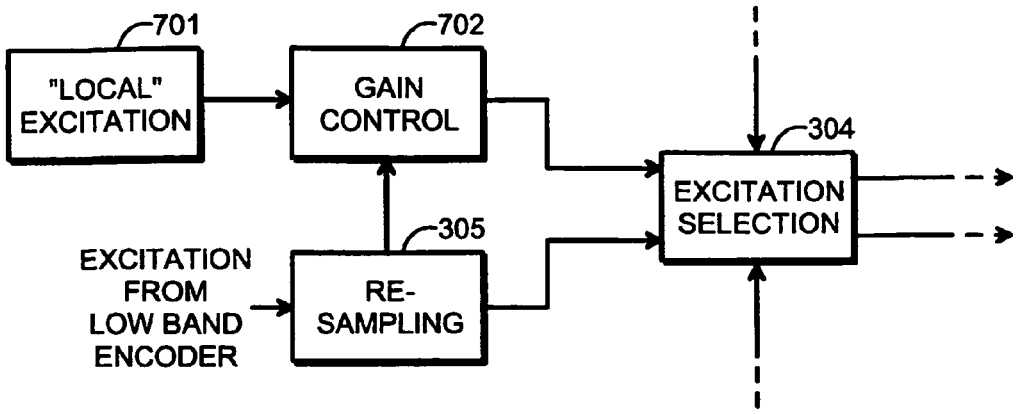
FIG. 7 illustrates the principle of excitation gain scaling according to an embodiment of the invention.

FIG. 7 illustrates a solution to the problem of excitation signal energy mismatch. A local excitation signal generator 701, where "local" means that it generates an excitation signal for the purposes of the high band encoder without direct reference to the LPC encoding of the low band, is augmented with a gain control functionality 702 that receives control information from the low band excitation signal resampling block 305. The task of the gain control functionality 702 is to scale the locally generated excitation signal onto a level at which its signal energy is within a predetermined tolerance around a measured signal energy of the low band excitation signal. This ensures that whatever selection is made at the excitation selection switch 304, the signal power of the selected excitation signal will not radically change from the level of the low band excitation signal. Extreme mismatches between a selected excitation signal and the high band LPC residual can be avoided, as long as a basic assumption holds according to which the low and high band LPC residuals resemble each other in terms of signal energy.

The LPC encoding process handles the input signal in discrete, consecutive sample trains. Similarly the excitation signals come in short pieces so that the finite number of samples that constitute one piece of an excitation signal may be expressed as a vector. We may denote a low band excitation vector as lb_exc and a corresponding random excitation vector as rand_exc. If we further assume the existence of scalar real variables exc_energy, rand_energy and scale_factor that describe the squared energy of the low band excitation signal, the squared energy of the random excitation signal and the scaling factor respectively, we may give the following pseudocode representation of the excitation gain scaling process:

/* Energy of resampled low band excitation */ exc_energy=lb_exc$^T$lb_exc;

/* Energy of random excitation */ rand_energy=rand_exc$^T$ rand_exc;

/* Scaling factor */ scale_factor=SQRT(exc_energy/rand_energy);

/*Scale random excitation*/ rand_exc=scale_factor*rand_exc;

Here $x^Tx$ means an inner product (dot product) of vector x, and SQRT(x) means the square root of x. The operator * on the last line of the pseudocode listing is a plain multiplication operator that is used e.g. in a product of a scalar and a vector. Comments not affecting the flow of execution are displayed between /*- and */-signs.

The arrangement of FIG. 7 can be inserted into the appropriate location of any of the arrangements of FIGS. 3 and 5. If there are several local excitation signal sources like in FIG. 5, they may all utilise a single, common gain control functionality or each of them may be equipped with a gain control functionality of its own. The order of the functionalities is not necessarily that presented in FIG. 7; for example it is possible to place the gain control functionality 702 after the excitation selection switch 304, in which case it should naturally be arranged to perform some true scaling only if the resampled low band excitation signal was not selected.

It should be noted that it is not absolutely necessary to perform excitation gain scaling, if the large variations in energy differences described above can be accepted or compensated for otherwise. However, the principle shown in FIG. 7 is an elegant way of largely eliminating the problem and complements nicely the overall principle of making an educated selection of the high band excitation signal.

The use of excitation gain scaling also enhances robustness against errors, or at least helps to minimise the effects of errors. As was explained previously in the description of blocks 304 and 502, the transmitter needs to signal to the receiver at least the information about whether the resampled low band excitation signal or the locally generated random excitation signal was used in the high band encoder. Signalling is typically accomplished by inserting a certain bit value into a signalling field. A transmission error may cause the receiver to interprete the transmitted signal value incorrectly, so that the receiver selects the wrong excitation signal for high band decoding. If, however, the transmitter applied excitation gain scaling to ensure that the energy of the excitation signal was the same in any case, inadvertently selecting an incorrect excitation signal at the receiver does not cause as bad an annoying audible effect as would be possible without excitation gain scaling at the transmitting end.

Figure 8:
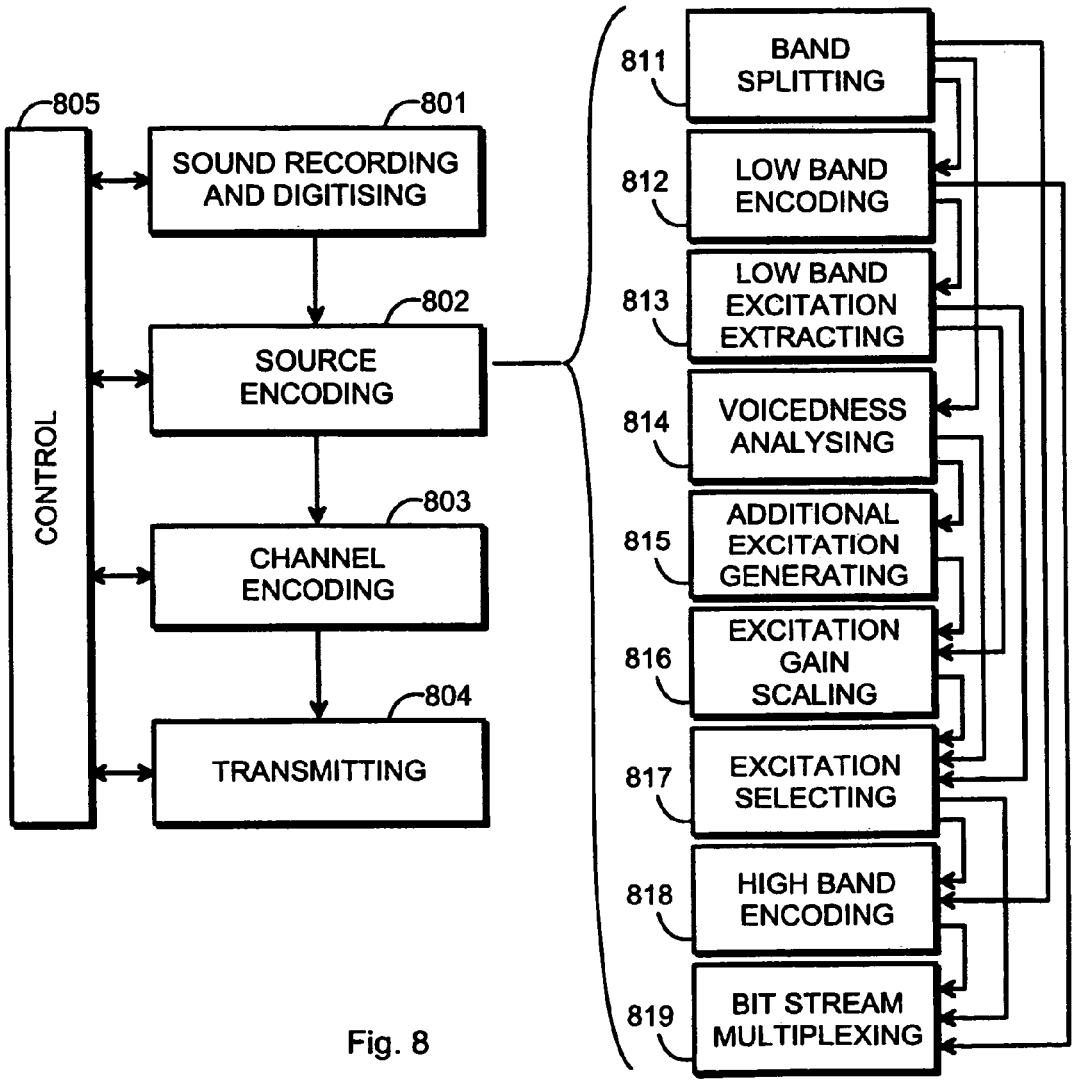
FIG. 8 illustrates a transmitter according to an embodiment of the invention.

FIG. 8 illustrates the presence of certain signal processing means in a transmitting device according to an embodiment of the invention. A transmission chain comprises a series connection of sound recording and digitising means 801, source encoding means 802, channel encoding means 803 and transmitting means 804. Of these, the sound recording and digitising means 801 are arranged to record and digitise sound. The source encoding means 802 are arranged to receive a bit stream representing digitised sound from the sound recording and digitising means 801 and to encode it as efficiently as possible, i.e. so that a very small number of encoded bits could convey the representation of the recorded sound with as high subjective quality as possible. The channel encoding means 803 are arranged to receive the source encoded bit stream from the source encoding means 802 and to add redundancy in order to make the bit robust against transmission errors. The transmitting means 804 are arranged to receive the channel encoded bit stream from the channel encoding means 803 and to transmit them through an antenna in the form of suitably modulated electromagnetic radiation. Control means 805 are provided to control the operation of the functional blocks of the transmission chain.

In accordance with the presented embodiment of the invention the source encoding means 802 comprise band splitting means 811, low band encoding means 812, low band excitation extracting means 813, voicedness analysing means 814, additional excitation generating means 815, excitation gain scaling means 816, excitation selecting means 817, high band encoding means 818 and bit stream multiplexing means 819. Of these the band splitting means 811 are arranged at least to separate the audio signal of one (low) band from the audio signal of another (high) band and to deliver the separated signals to the appropriate band-specific encoders. Some route must also exist from the band splitting means 811 to voicedness analysing means 814, so that the last-mentioned may examine, whether the separated bands comprise signals of voiced character. This route has been drawn as a direct connection in FIG. 8 for reasons of graphical clarity, although the corresponding information would more probably come to the voicedness analysing means 814 through the band-specific encoders.

The low band encoding means 812, sometimes also referred to as the core encoder means, are arranged to receive the separated low band audio signal, to encode it using LPC encoding and to deliver the low band excitation signal (through certain conceptually defined low band excitation extracting means 813, which also include resampling if any is required) to the excitation selecting means 817. If excitation gain scaling is applied, the low band excitation signal is also arranged to be conveyed to the excitation gain scaling means 816, which are arranged to receive a locally generated excitation signal from the additional excitation generating means 815 and to scale its signal energy appropriately. In embodiments of the invention where information about the potential voicedness of the high band signal is used to introduce periodicity into the locally generated excitation signal, there must be a connection from the voicedness analysing means 814 to the additional excitation generating means 815 for conveying the required information.

The excitation selecting means 817 are arranged to receive the low band excitation signal, the voicedness information and the locally generated excitation signal from blocks 813, 814 and 816 (or 815) respectively, to select the excitation according to the received voicedness information and preprogrammed selection rules, and to deliver the selected excitation signal to the high band encoding means 818 as well as the appropriate excitation signal selection information to the bit stream multiplexing means 819. The high band encoding means 818 are arranged to perform high band LPC encoding with the help of the excitation signal received from the excitation selecting means 817. The bit stream multiplexing means 819 are arranged to receive the encoding results of the low band encoding means 812 and the high band encoding means 818 and the excitation signal selection information from the excitation selecting means 817. The bit stream multiplexing means 819 are additionally arranged to multiplex said information into an appropriate bit stream that represents complete source encoded information, which bit stream can be delivered to the channel encoding means 803.

Figure 9:
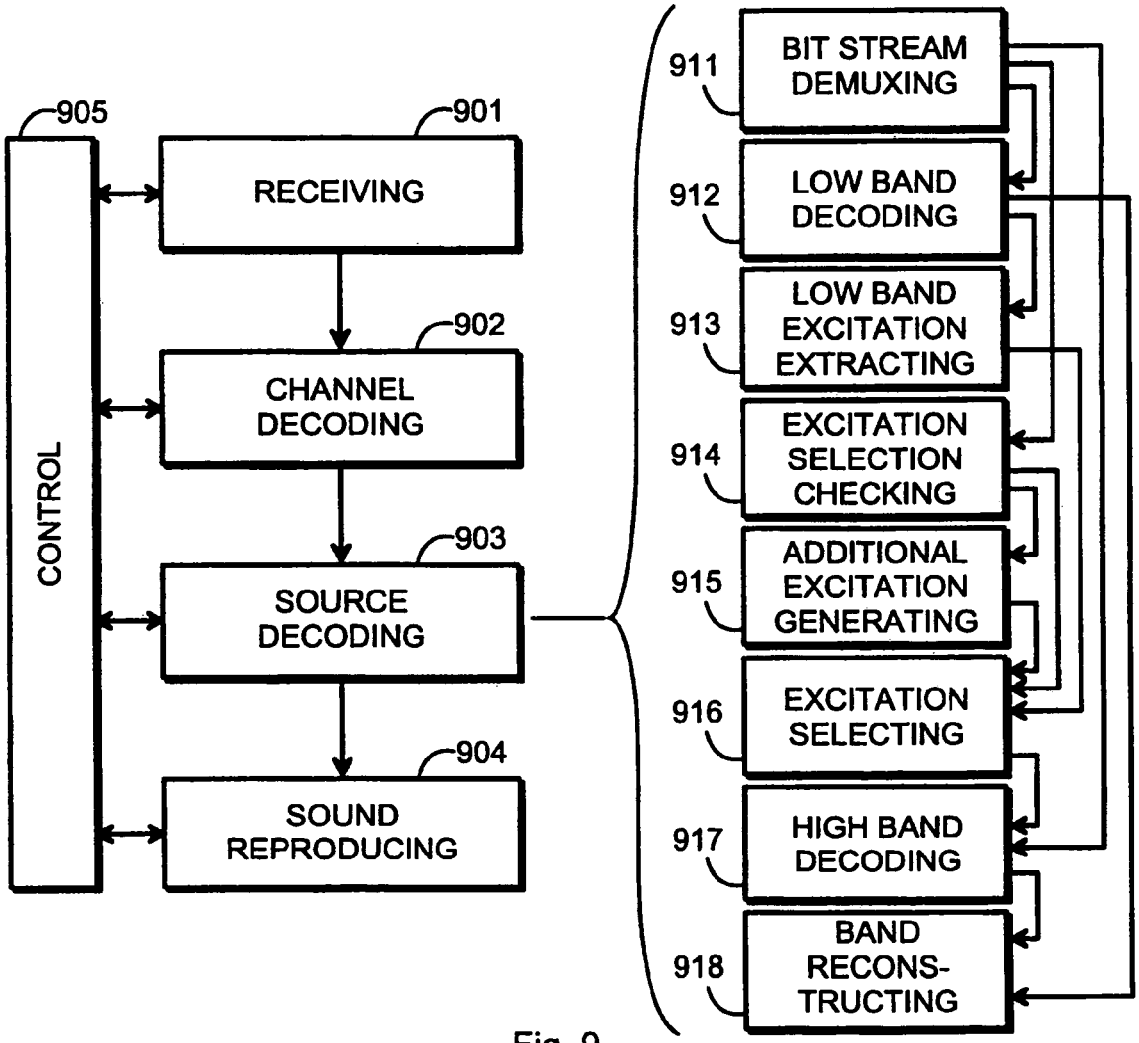
FIG. 9 illustrates a receiver according to an embodiment of the invention.

FIG. 9 illustrates the presence of certain signal processing means in a receiving device according to an embodiment of the invention. A reception chain comprises a series connection of receiving means 901, channel decoding means 902, source decoding means 903 and sound reproducing means 904. The receiving means 901 and channel decoding means 902 together perform equalisation, detection and channel decoding, the purpose of which is to convert received electromagnetic radiation into an as reliable copy as possible of what the channel encoder received from the source encoder in a transmitting device. The task of the source decoding means 903 is to reverse the effect of source encoding, so that after source decoding the resulting audio signal can be delivered to the sound reproducing means 904 for conversion into acoustic waves. Control means 905 are provided to control the operation of the functional blocks of the reception chain.

In accordance with the presented embodiment of the invention the source decoding means 903 comprise bit stream demultiplexing means 911, low band decoding means 912, low band excitation signal extracting means 913, excitation selection checking means 914, additional excitation signal generating means 915, excitation selecting means 916, high band decoding means 917 and band reconstructing means 918. Of these the bit stream demultiplexing means 911 are arranged to demultiplex the received bit stream and to direct the appropriate portions thereof to the low band decoding means 912, the excitation selection checking means 914 and the high band decoding means 917. The low band decoding means 912 are arranged to perform standard LPC decoding for the low band audio signal and to deliver decoding results to the band reconstructing means 918. The low band decoding means 912 also deliver the low band excitation signal (through certain conceptually defined low band excitation extracting means 913, which also include resampling if any is required) to the excitation selecting means 916.

The excitation selection checking means 914 are arranged to examine an appropriate part of the received bit stream to find an indication about whether the high band encoder in the transmitting device used the low band excitation signal or a locally generated excitation signal in encoding the high band. The excitation selection checking means 914 are arranged to deliver this indication as an instruction to the excitation selecting means 916. In embodiments of the invention where the locally generated excitation signal may comprise periodicity, the excitation selection checking means 914 also recover the appropriate periodicity information from the received bit stream and deliver it to the additional excitation signal generating means 915. The excitation selecting means 916 are arranged to receive the low band excitation signal, the locally generated excitation signal and the excitation selection information from blocks 913, 915 and 914 respectively, to select the appropriate excitation according to the received selection information, and to deliver the selected excitation signal to the high band decoding means 917.

It should be noted that the receiver need not be affected at all by the detail, whether excitation gain scaling is applied in the transmitter or not. The receiver just accepts the excitation selection information and the high band gain information from the transmitter, regardless of the way in which they were produced. Naturally the application of excitation gain scaling in the transmitter and the resulting enhanced accuracy in quantization of the excitation gain enables the receiver to reproduce the high band audio signal more accurately, but the receiver does not need to know, whether the advantageous circumstances were due to deliberately taken action in the transmitter or just good luck.

The high band decoding means 917 are arranged to perform LPC decoding within the high band by starting from the encoded high band information received from the bit stream demultiplexing means 911 and with the help of the excitation signal received from the excitation selecting means 916. The band reconstructing means 918 are arranged to collect the decoded audio information from the low band decoding means 912 and the high band decoding means 917 and to combine them into a single wideband audio signal that can be delivered to the sound reproducing means 904.

The invention has been presented above in the exclusive context of LPC. However, it is possible to generalise the same principle so that we just assume the following:

- band splitting is utilised to separate a most important frequency band from one or more other frequency bands of lesser importance,
- a core encoder is employed to encode the input signal within the most important frequency band,
- the characteristics of the signals in different frequency bands are examined in order to determine, whether there is a certain resemblance therebetween,
- depending on the results of such examining, either some characteristic features of the core encoding process are extracted and used in the encoding of the other frequency bands or they are replaced with a locally generated, independent set of corresponding features in the encoding of the other frequency bands, and
- possibly a harmonisation step is taken in order to standardise an important part in the locally generated, independent set of corresponding features to match a corresponding part of the extracted characteristic features.

What is claimed is:

1. A method for digitally encoding sound, comprising:

a) splitting an input signal into a primary frequency band and at least one secondary frequency band;

b) digitally encoding the part of the input signal in the primary frequency band;

c) examining certain characteristics of the input signal in the primary frequency band and corresponding characteristics of the input signal in at least one secondary frequency band in order to find out, whether there is certain resemblance therebetween; and d1) if there is said certain resemblance, extracting certain characteristic features of the process applied to encoding the input signal in the primary frequency band and digitally encoding the part of the input signal in the secondary frequency band or bands using such extracted characteristic features;

d2) otherwise replacing such extracted characteristic features with a locally generated, independent set of corresponding features and digitally encoding the part of the input signal in the secondary frequency band or bands using said locally generated, independent set of corresponding features.

2. A method according to claim 1:

wherein the digitally encoding the part of the input signal in the primary frequency band corresponds to applying linear predictive coding to the input signal in the primary frequency band, involving the generation of a primary frequency band excitation signal, wherein digitally encoding the part of the input signal in the secondary frequency band or bands corresponds to applying linear predictive coding to the input signal in a secondary frequency band, involving the use of a secondary frequency band excitation signal, wherein the extracting certain characteristic features of the process applied to encoding the input signal in the primary frequency band and digitally encoding the part of the input signal in the secondary frequency band or bands using such extracted characteristic features, corresponds to extracting the primary frequency band excitation signal and delivering the primary frequency band excitation signal or a derivative thereof for use as the secondary frequency band excitation signal, and wherein the replacing such extracted characteristic features with a locally generated, independent set of corresponding features and digitally encoding the part of the input signal in the secondary frequency band or bands using said locally generated, independent set of corresponding features, corresponds to generating the secondary frequency band excitation signal independently of the primary frequency band excitation signal.

3. A method according to claim 2, wherein the replacing such extracted characteristic features with a locally generated, independent set of corresponding features and digitally encoding the part of the input signal in the secondary frequency band or bands using said locally generated, independent set of corresponding features, corresponds to generating a random excitation signal.

4. A method according to claim 2, wherein the replacing such extracted characteristic features with a locally generated, independent set of corresponding features and digitally encoding the part of the input signal in the secondary frequency band or bands using said locally generated, independent set of corresponding features, comprises:

examining whether the input signal in a secondary frequency band exhibits voicedness, and depending on the results of such examining:

generating a periodic excitation signal, if the input signal in a secondary frequency band was found to exhibit voicedness, or generating a random excitation signal, if the input signal in a secondary frequency band was not found to exhibit voicedness.

5. A method according to claim 2, wherein the extracting certain characteristic features of the process applied to encoding the input signal in the primary frequency band and digitally encoding the part of the input signal in the secondary frequency band or bands using such extracted characteristic features, corresponds to extracting the primary frequency band excitation signal, resampling the primary frequency band excitation signal and using the resampled primary frequency band excitation signal as the secondary frequency band excitation signal.

6. A method according to claim 2, comprising modifying the secondary frequency band excitation signal generated in the replacing such extracted characteristic features with a locally generated, independent set of corresponding features and digitally encoding the part of the input signal in the secondary frequency band or bands using said locally generated, independent set of corresponding features, in order to match its signal energy with a signal energy of said primary frequency band excitation signal.

7. A method according to claim 6, comprising:

extracting the primary frequency band excitation signal, calculating a first energy value representative of a signal energy of said primary frequency band excitation signal, generating the secondary frequency band excitation signal, calculating a second energy value representative of a signal energy of said secondary frequency band excitation signal, and scaling said secondary frequency band excitation signal with a ratio of the first energy value and the second energy value.

8. A method according to claim 1, wherein:

the examining certain characteristics of the input signal in the primary frequency band and corresponding characteristics of the input signal in at least one secondary frequency band in order to find out, whether there is certain resemblance therebetween corresponds to examining, whether the input signal in the primary frequency band exhibits voicedness and whether the input signal in a secondary frequency band exhibits voicedness, the extracting certain characteristic features of the process applied to encoding the input signal in the primary frequency band and digitally encoding the part of the input signal in the secondary frequency band or bands using such extracted characteristic features, is executed if both the input signal in the primary frequency band and the input signal in a secondary frequency band are found to exhibit voicedness or if the input signal in the primary frequency band is found to not exhibit voicedness, and the replacing such extracted characteristic features with a locally generated, independent set of corresponding features and digitally encoding the part of the input signal in the secondary frequency band or bands using said locally generated, independent set of corresponding features, is executed if the input signal in the primary frequency band is found to exhibit voicedness and the input signal in a secondary frequency band is found to not exhibit voicedness.

9. A method according to claim 8, wherein the examination of whether the input signal in a frequency band exhibits voicedness comprises:

calculating a long-term correlation gain for the input signal in question and comparing the calculated long-term correlation gain to a threshold value; so that the input signal in a frequency band is found to exhibit voicedness if the calculated long-term correlation gain is found to be greater than a corresponding threshold value.

10. A method for decoding digitally encoded sound, comprising:

a) receiving an encoded input signal split into a primary frequency band and at least one secondary frequency band, which secondary frequency band has been encoded separately from the primary frequency band;

b) decoding the part of the input signal in the primary frequency band;

c) examining the input signal in order to find out, what indication does the input signal contain about utilising characteristic features of the process applied to encoding the primary frequency band in the process applied to encoding the secondary frequency band; and d1) if there is said certain resemblance, extracting certain characteristic features of the process applied to decoding the input signal in the primary frequency band and decoding the part of the input signal in the secondary frequency band or bands using such extracted characteristic features, or d2) otherwise replacing such extracted characteristic features with a locally generated, independent set of corresponding features and decoding the part of the input signal in the secondary frequency band or bands using said locally generated, independent set of corresponding features.

11. A method according to claim 10, wherein decoding the part of the input signal in the primary frequency band corresponds to decoding a linear-predictive-coded input signal in the primary frequency band, involving the generation of a primary frequency band excitation signal, wherein decoding the part of the input signal in the secondary frequency band or bands corresponds to decoding a linear-predictive-coded input signal in that secondary frequency band, involving the use of a secondary frequency band excitation signal, wherein extracting certain characteristic features of the process applied to decoding the input signal in the primary frequency band and decoding the part of the input signal in the secondary frequency band or bands, using such extracted characteristic features, corresponds to extracting the primary frequency band excitation signal and delivering the primary frequency band excitation signal or a derivative thereof for use as the secondary frequency band excitation signal, and wherein replacing such extracted characteristic features with a locally generated, independent set of corresponding features and decoding the part of the input signal in the secondary frequency band or bands using said locally generated, independent set of corresponding features, corresponds to generating the secondary frequency band excitation signal independently of the primary frequency band excitation signal.

12. A method according to claim 11, wherein replacing such extracted characteristic features with a locally generated, independent set of corresponding features and decoding the part of the input signal in the secondary frequency band or bands using said locally generated independent set of corresponding features, corresponds to generating a random excitation signal.

13. A method according to claim 11, wherein replacing such extracted characteristic features with a locally generated, independent set of corresponding features and decoding the part of the input signal in the secondary frequency band or bands using said locally generated, independent set of corresponding features, examining whether the input signal contains an indication about periodicity in the secondary frequency band, and depending on the results of such examining:

generating a periodic excitation signal, if the input signal contains an indication about periodicity in the secondary frequency band, or generating a random excitation signal, if the input signal does not contain any indication about periodicity in the secondary frequency band.

14. A method according to claim 11, wherein extractin certain characteristic features of the process applied to decoding the input signal in the primary frequency band and decoding the part of the input signal in the secondary frequency band or bands using such extracted characteristic features, corresponds to extracting the primary frequency band excitation signal, resampling the primary frequency band excitation signal and using the resampled primary frequency band excitation signal as the secondary frequency band excitation signal.

15. A transmitter apparatus for transmitting digitally encoded sound, comprising:

a band splitter adapted to split an input signal into a primary frequency band and at least one secondary frequency band, a primary encoder adapted to digitally encode the part of the input signal in the primary frequency band, a secondary encoder adapted to digitally encode the part of the input signal in a secondary frequency band, an examining portion adapted to examine certain characteristics of the input signal in the primary frequency band and corresponding characteristics of the input signal in at least one secondary frequency band and to indicate, whether there is certain resemblance therebetween, an extracting portion adapted to extract certain characteristic features of a process applied to encoding the input signal in the primary frequency band, for use in a process applied to encoding the input signal in the secondary frequency band, and a replacing portion adapted to replace such extracted characteristic features with a locally generated, independent set of corresponding features in the process applied to encoding the input signal in the secondary frequency band;

wherein said extracting portion and said replacing portion are arranged to be operationally alternative to each other depending on an indication produced by said examining portion.

16. A transmitter apparatus according to claim 15, wherein:

the primary encoder is a linear predictive coder capable of generating a primary frequency band excitation signal, the secondary encoder is a linear predictive coder capable of using a secondary frequency band excitation signal, said extracting portion is adapted to extract a primary frequency band excitation signal and to deliver the primary frequency band excitation signal or a derivative thereof to the secondary encoder for use as the secondary frequency band excitation signal, and said replacing portion is adapted to generate a secondary frequency band excitation signal independently of the primary frequency band excitation signal.

17. A transmitter apparatus according to claim 16, wherein said replacing portion is adapted to generate a random excitation signal.

18. A transmitter apparatus according to claim 16, wherein said replacing portion is adapted to examine whether the input signal in a secondary frequency band exhibits voicedness, and to generate a periodic excitation signal, if the input signal in a secondary frequency band was found to exhibit voicedness, and to generate a random excitation signal, if the input signal in a secondary frequency band was not found to exhibit voicedness.

19. A transmitter apparatus according to claim 16, wherein said extracting portion comprises a resampler adapted to resample the primary frequency band excitation signal and to deliver the resampled primary frequency band excitation signal for use as the secondary frequency band excitation signal.

20. A transmitter apparatus according to claim 16, comprising a signal modifier adapted to modify the secondary frequency band excitation signal generated by said replacing portion in order to match its signal energy with a signal energy of said primary frequency band excitation signal.

21. A transmitter apparatus according to claim 20, comprising:

extractor for extracting the primary frequency band excitation signal, calculator for calculating a first energy value representative of a signal energy of said primary frequency band excitation signal, generator for generating the secondary frequency band excitation signal, second calculator for calculating a second energy value representative of a signal energy of said secondary frequency band excitation signal, and scaler for scaling said secondary frequency band excitation signal with a ratio of the first energy value and the second energy value.

22. A transmitter apparatus according to claim 15, wherein:

said examining portion is adapted to examine, whether the input signal in the primary frequency band exhibits voicedness and whether the input signal in a secondary frequency band exhibits voicedness, said extracting portion is adapted to be selected for operation if both the input signal in the primary frequency band and the input signal in a secondary frequency band are found to exhibit voicedness or if the input signal in the primary frequency band is found to not exhibit voicedness, and said replacing portion is adapted to be selected for operation if the input signal in the primary frequency band is found to exhibit voicedness and the input signal in a secondary frequency band is found to not exhibit voicedness.

23. A transmitter apparatus according to claim 22, wherein the examining portion is adapted to calculate long-term correlation gains for input signals and to compare the calculated long-term correlation gains to threshold values, so that the input signal in a frequency band is found to exhibit voicedness if the calculated long-term correlation gain is found to be greater than a corresponding threshold value.

24. A receiver apparatus for receiving and decoding digitally encoded sound, comprising:

a receiver adapted to receive an encoded input signal split into a primary frequency band and at least one secondary frequency band, which secondary frequency band has been encoded separately from the primary frequency band, a primary decoder adapted to decode the part of the input signal in the primary frequency band, a secondary decoder adapted to decode the part of the input signal in a secondary frequency band, a examining portion adapted to examine the input signal and to find out what indication does the input signal contain about utilising characteristic features of the process applied to encoding the primary frequency band in the process applied to encoding the secondary frequency band, an extracting portion adapted to extract certain characteristic features of a process applied to decoding the input signal in the primary frequency band and to use such extracted characteristic features in a process applied to decoding the input signal in the primary frequency band, and a replacing portion adapted to replace such extracted characteristic features with a locally generated, independent set of corresponding features in the process applied to decoding the input signal in the primary frequency band;

wherein said extracting portion and said replacing portion are arranged to be operationally alternative to each other depending on an indication found by said examining portion.

25. A receiver apparatus according to claim 24, wherein:

the primary decoder is adapted to decode a linear-predictive-coded input signal in the primary frequency band and to generate a primary frequency band excitation signal, the secondary decoder is adapted to decode a linear-predictive-coded input signal in a secondary frequency band and to use a secondary frequency band excitation signal, said extracting portion is adapted to extract the primary frequency band excitation signal and to deliver the primary frequency band excitation signal or a derivative thereof to the secondary decoder as the secondary frequency band excitation signal, and said replacing portion is adapted to generate the secondary frequency band excitation signal independently of the primary frequency band excitation signal.

26. A receiver apparatus according to claim 25, wherein said replacing portion is adapted to generate a random excitation signal.

27. A receiver apparatus according to claim 25, wherein said replacing portion is adapted to examine whether the input signal contains an indication about periodicity in the secondary frequency band, and depending on the results of such examining to generate a periodic excitation signal, if the input signal contains an indication about periodicity in the secondary frequency band, or to generate a random excitation signal, if the input signal does not contain any indication about periodicity in the secondary frequency band.

28. A receiver apparatus according to claim 24, wherein said extracting portion comprises a resampler adapted to resample the primary frequency band excitation signal and to deliver the resampled primary frequency band excitation signal for use as the secondary frequency band excitation signal.

29. A transmitter apparatus for transmitting digitally encoded sound, comprising:

means for splitting an input signal into a primary frequency band and at least one secondary frequency band, means for digitally encoding the part of the input signal in the primary frequency band, means for digitally encoding the part of the input signal in a secondary frequency band, means for examining certain characteristics of the input signal in the primary frequency band and corresponding characteristics of the input signal in at least one secondary frequency band and indicating whether there is certain resemblance therebetween, means for extracting certain characteristic features of a process applied to encoding the input signal in the primary frequency band, for use in a process applied to encoding the input signal in the secondary frequency band, and means for replacing such extracted characteristic features with a locally generated, independent set of corresponding features in the process applied to encoding the input signal in the secondary frequency band;

wherein said means for extracting and said means for replacing are arranged to be operationally alternative to each other depending on an indication produced by said examining means.

* * * * *

UNITED STATES PATENT AND TRADEMARK OFFICE

CERTIFICATE OF CORRECTION

PATENT NO. : 7,376,554 B2
APPLICATION NO. : 10/891846
DATED : May 20, 2008
INVENTOR(S) : Ojala et al.

It is certified that error appears in the above-identified patent and that said Letters Patent is hereby corrected as shown below:

1. At column 13, line 6, please remove the phrase “said certain resemblance” and insert --if there is said such an indication found--.

2. At column 13, line 11, please remove the word “or” and replace with the word --and--.

3. At column 13, line 58, please insert --comprises:-- after the word “features”.

4. At column 14, line 1, please delete the word “extractin” and insert --extracting--.

5. At column 15, line 11, please insert the word --an-- before the word “extractor”.

6. At column 15, line 13, please insert the word --a-- before the word “calculator”.

7. At column 15, line 16, please insert the word --a-- before the word “generator”.

8. At column 15, line 18, please insert the word --a-- before the word “second”.

9. At column 15, line 21, please insert the word --a-- before the word “scaler”.

10. At column 15, line 60, please remove the word “a” and replace with --an--.

Signed and Sealed this

Fifth Day of August, 2008

JON W. DUDAS
*Director of the United States Patent and Trademark Office*